United States Patent [19]

Lohner

[11] 4,183,342

[45] Jan. 15, 1980

[54] FUEL INJECTION SYSTEM FOR COMPRESSION IGNITION (DIESEL) INTERNAL COMBUSTION ENGINES

[75] Inventor: Ingolf Löhner, Braunschweig, Fed. Rep. of Germany

[73] Assignee: Volkswagenwerk Aktiengesellschaft, Wolfsburg, Fed. Rep. of Germany

[21] Appl. No.: 868,736

[22] Filed: Jan. 12, 1978

[30] Foreign Application Priority Data

Jan. 15, 1977 [DE] Fed. Rep. of Germany ..... 2701531

[51] Int. Cl.[2] ..... F02D 1/02

[52] U.S. Cl. ..... 123/179 L; 123/139 AP; 123/140 J

[58] Field of Search ..... 123/179 L, 179 G, 179 C, 123/139 AP, 139 ST, 140 J, 32 JT, 187.5 R, 98, 99, 104

[56] References Cited

U.S. PATENT DOCUMENTS

| | | | |
|---|---|---|---|
| 1,614,493 | 1/1927 | Rochefort | 123/139 AP |
| 2,050,392 | 8/1936 | Starr | 123/139 AP |
| 2,063,848 | 12/1936 | Meyer et al. | 123/140 MP |
| 2,624,327 | 1/1953 | Hogeman | 123/139 AP |

FOREIGN PATENT DOCUMENTS

| | | | |
|---|---|---|---|
| 227218 | 10/1909 | Fed. Rep. of Germany. | |
| 644442 | 4/1937 | Fed. Rep. of Germany. | |
| 663908 | 7/1938 | Fed. Rep. of Germany. | |
| 833278 | 1/1952 | Fed. Rep. of Germany. | |
| 2148762 | 4/1973 | Fed. Rep. of Germany | 123/179 G |

*Primary Examiner*—Charles J. Myhre
*Assistant Examiner*—M. Moy
*Attorney, Agent, or Firm*—Brumbaugh, Graves, Donohue & Raymond

[57] ABSTRACT

A fuel injection system for a compression ignition (Diesel) internal combustion engine, having a fuel injection pump and devices, associated therewith, for increasing the idling speed and advancing the injection timing during cold starting. The idling speed increasing device is coupled to the injection timing advancing device such that both may be operated simultaneously.

3 Claims, 2 Drawing Figures

FUEL INJECTION SYSTEM FOR COMPRESSION IGNITION (DIESEL) INTERNAL COMBUSTION ENGINES

BACKGROUND OF THE INVENTION

This invention concerns a fuel injection system for a compression ignition (Diesel) internal combustion engine with an adjustment device, acting on the speed control lever of the fuel injection pump, for increasing the idling speed of the engine when the engine is started in the cold condition.

Inasmuch as the frictional losses are larger when the engine is cold, the idling speed of the engine is substantially lower during cold starting than when the engine is warm. As one means to compensate for reduced idling speed, an adjustment device acting on the speed control lever of the injection pump has been proposed which causes more fuel to be injected during the periods of cold starting and warm-up. Once warm-up has occurred, the adjustment device returns the speed control lever to its normal predetermined idling position, thus avoiding a speed increase of the engine with an attendant smoke development after the cold start.

In addition to increased frictional losses during cold starting and warm-up, there is also a problem of incomplete combustion, since the injection timing of the injection pump is adjusted for normal engine operating temperature. It has been proposed that this problem can be overcome and more complete combustion in the Diesel cycle achieved by advancing the injection timing on cold starting and during the warming-up phase. This can be effected by means of a timing control element acting on an injection timing advancing mechanism.

It is desirable to provide a simple and inexpensive means for improving the engine performance during cold starting and during warm-up, while at the same time permitting normal engine operation after warm-up has taken place.

SUMMARY OF THE INVENTION

In accordance with this invention, there is provided a fuel injection system for a compression ignition (Diesel) internal combustion engine having a fuel injection pump, a device for increasing the idling speed of the engine during cold starting, and a device for advancing the injection timing during cold starting. The idling speed increasing device is coupled to the injection timing advancement device so that both devices may be operated simultaneously. In the preferred embodiments, the idling speed increasing device is coupled to a pivotable speed control lever on the injection pump for adjusting the position of the lever during cold starting, and the injection pump has a pivotable timing control element acting on the device for advancing the injection timing. The idling speed increasing device, which may be a cable, is coupled to the timing control element, which itself is operable in response to either a hand operated pull means or to an automatic activating means, such as a thermostat, for simultaneously actuating the timing control element to advance the injection timing and also the speed control lever to increase the idling speed.

The coupling of the two adjustment devices becomes possible because both adjustments are to be achieved at about the same operating state; namely, on cold starting and on warming-up. The fuel injection system in accordance with the invention results in a substantially improvement of the operating conditions of the engine by means of comparatively simple actuation, especially in automobiles equipped with Diesel engines. Thus, when the driver starts the Diesel engine cold, he needs only to actuate the joint hand-operated pull mechanism-which resembles a hand choke for enriching the fuel-air mixture during the cold start of a spark-ignited internal combustion engine—in order to achieve simultaneously an idling speed increase and an advancement of the injection timing of the fuel injection pump, both of which will result in improved operating conditions while the engine is cold. At the same time, this result is accomplished by means of a relatively simple device requiring little in the way of modification of the existing design of fuel injection devices. Of course, it is also possible, in place of manual actuation of the two coupled adjustment devices, to provide an automatic actuation mechanism, e.g., by means of an adjustment drive controlled as a function of a characteristic temperature of the internal combustion engine.

BRIEF DESCRIPTION OF THE DRAWINGS

For the purpose of illustrating the preferred embodiments of the invention, reference is made to the accompanying drawings, in which.

DETAILED DESCRIPTION OF THE PREFERRED EMBODIMENTS

Figure 1:
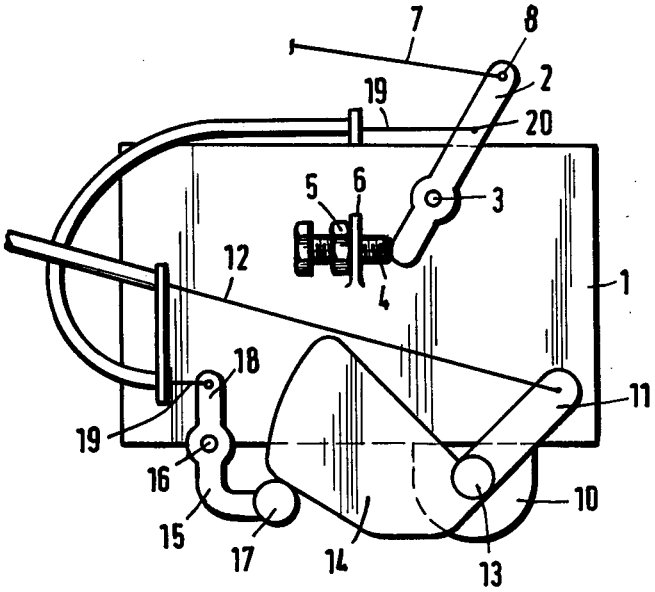
FIG. 1 shows a fuel injection system according to the present invention utilizing a manually-operated adjustment device.

Referring to the drawings, a fuel injection system according to the injection has a fuel injection pump 1 for delivering fuel to the engine (not shown) and a speed control lever 2, pivotally mounted on an axis 3, which is connected, by way of means well known in the art and not shown here, with a device for modification of the fuel quantity to be delivered to the engine. During idling, the speed control lever is rotated clockwise and rests against an idle stop 4. The idle stop 4, which may constitute a threaded bolt screwed into a retaining bracket 6, is adjustable for setting the idling speed, and can be fixed in a given position by means of a nut 5. The idle stop 4 is normally positioned so as to achieve a predetermined idling speed when the operating temperature of the engine is warm. A cable line 7 is connected at one end 8 to the speed control lever 2 and at the other end to the gas pedal of the vehicle, not shown here. When the gas pedal is depressed, the speed adjusting lever is displaced counterclockwise whereby the fuel quantity supplied to the Diesel engine, and thereby the speed of the engine is increased.

Means 10 for advancing the injection timing of the injection pump of an internal combustion engine are also well known in the art. For example, U.S. Pat. No. 2,063,848 to Meyer, et al. discloses a mechanism which will adjust the injection timing in response to engine speed. Associated with the timing adjustment mechanism in Meyer is a manually-operated cord which may be used to advance the injection timing on cold starting. An improved mechanism for advancing the injection timing on cold starting is shown in the commonly-owned U.S. patent application Ser. No. 686,010, filed May 13, 1976, the disclosure of which is incorporated herein by reference. As disclosed in that application, the injection timing may be adjusted in response to engine speed by means of an adjustment piston which can be acted on by a pressure medium in opposition to a spring, thereby adjusting the injection timing of the injection pump as a function of the control pressure. In addition, a plunger, which overrides the pressure advance mechanism, is provided for advancing the injection timing on cold starting. This plunger may be actuated by means of a timing control element or adjustment lever which, as is shown in FIG. 3 of that application, is pivotally connected such that rotation of the element causes the plunger to move inwardly, advancing the timing. In the present application, this timing control element or adjustment lever is designated as 11, and is rotated about the center shaft 13 in a counterclockwise direction by means of a manually operated cable line 12.

Also, connected to the timing control element or lever 11, and rotable therewith, is a cam plate 14. The cam plate 14 engages a follower 17 at one end of a rocking lever 15 which pivots about an axis 16. By rotating the adjusting lever 11 and thereby the cam plate 14 counterclockwise, the rocking lever 15 is pivoted in a clockwise direction. One end of a cable line 19, whose other end is fastened on the speed adjusting lever 2 at point 20, is fastened to the lever arm 18 of the rocking lever 15, thereby coupling the idling speed increasing means and the injection timing advancing means.

In operation, when the adjustment lever 11 is rotated to advance the timing, the rocking lever 15 rotates clockwise, causing the speed control lever 2 to pivot counterclockwise, i.e., in the direction of an increase in the injected fuel quantity and, therefore, the engine speed. Accordingly, if during the period of cold starting and warming-up of the Diesel engine, the adjusting lever 11 is displaced counterclockwise by a given angle by means of the manual cable line 12, there is obtained thereby both an advancement of the injection timing and, by means of the cam plate 14, the rocking lever 15 and the cable line 19, a displacement of the speed adjustment lever 2 in the direction of an increase of the idling speed. This displacement has the same effect as a manual adjustment of the adjustment stop 4. However, it can be reversed in case of reversal of the adjustment of the cable 12 and, respectively, a corresponding counter rotation of the adjustment lever 11. This return adjustment of the cable 12 should occur whenever the internal combustion engine has reached its operating temperature, i.e., after a few minutes of operation.

Figure 2:
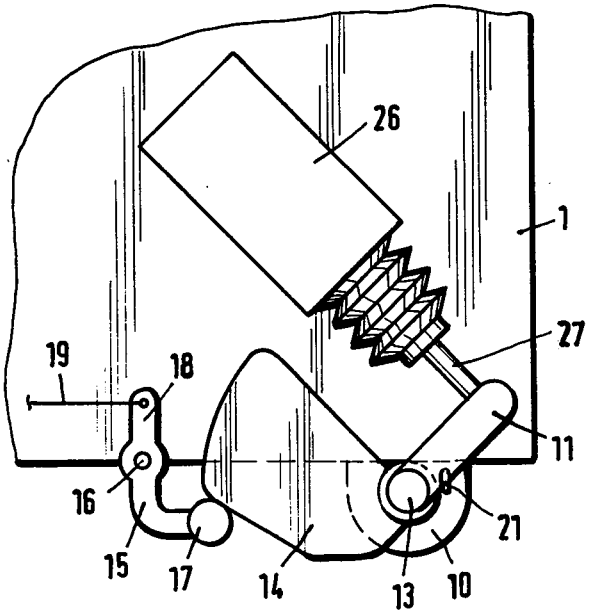
FIG. 2 shows a portion of the fuel injection system of FIG. 1, having an automatic actuation mechanism.

In place of the manual adjustment shown in FIG. 1, automatic adjustment may be provided, as shown in FIG. 2. The cable 12 is replaced by a thermostatic drive mechanism 26 which acts on the free end of the adjusting lever 11 by means of an actuating pin 27. The adjusting lever is biased in a counterclockwise direction by means of spring 21. This thermostatic drive mechanism 26 may be controlled by a characteristic temperature of the internal combustion engine where, for instance, the drive is heated by the engine coolant. FIG. 2 shows a pertinent arrangement in the warmed-up operating state wherein the thermostatic drive 26 has moved out the actuating pin 27. The cam plate 14 and the rocking lever 15 are then in such a position that no adjustment of the speed control lever 2 is effected by way of the cable line 19, and the idling speed will be determined by setting of the idling stop 4. When the Diesel engine is started cold, i.e., when the cooling water still has a very low temperature, the actuating pin 27 of the thermostatic drive mechanism 26 will be retracted so that the return spring 21 displaces the adjustment lever 11 counterclockwise into such position that by way of the cam plate 14, the rocking lever 15 and the connecting cable 19, the speed adjusting lever 2 is displaced counterclockwise, causing both an increase in the injection timing along with an increase in idle speed.

The above-described embodiments of the invention are intended to be merely exemplary, and do not constitute a limitation of the claims. It is possible to provide a device other than the one mentioned for advancement of the injection timing of the injection pump and to couple the same, e.g., by hydraulic or other means, with an arrangement for increasing the idling speed. Thus, when such other devices are used, the means of adjustment, whether effected manually, or, e.g., as a function of a characteristic temperature of the engine, would be modified accordingly, and thus provide a means for advancing the injection timing while simultaneously increasing the idling speed. All such modifications are intended to be within the scope of the invention as defined in the following claims.

I claim:

1. A fuel injection system for a compression ignition (Diesel) internal combustion engine comprising a fuel injection pump; means associated with said injection pump for increasing the idling speed of the engine during cold starting; and means associated with said injection pump for advancing the injection timing during cold starting; said idling speed increasing means being coupled to said injection timing advancing means for simultaneous operation therewith.

2. The fuel injection system defined in claim 1, further comprising a speed control lever associated with said injection pump, and wherein said idling speed increasing means is coupled to said lever for adjusting the position thereof during cold starting.

3. The fuel injection system defined in claim 2, wherein said injection timing advancing means includes a timing control element associated with said injection pump for advancing the injection timing of said injection pump, and wherein said system further comprises hand-operated pull means, coupled to said idling speed increasing means and said injection timing advancing means, for simultaneously actuating said speed control lever to increase the idling speed and said timing control element to advance the injection timing of said injection pump.

* * * * *